United States Patent [19]

Woodall, Jr.

[11] 4,195,841

[45] Apr. 1, 1980

[54] DIE CHANNEL DESIGN WITH ANTI-DIE LODGING PROVISION

[76] Inventor: William E. Woodall, Jr., 207 E. Morgan St., Benson, N.C. 27504

[21] Appl. No.: 937,142

[22] Filed: Aug. 28, 1978

[51] Int. Cl.[2] ..... A63F 9/04

[52] U.S. Cl. ..... 273/145 C

[58] Field of Search ..... 273/145 R, 145 A, 145 B, 273/145 C, 145 D, 145 E, 144 R, 144 A, 144 B

[56] References Cited

U.S. PATENT DOCUMENTS

| | | | |
|---|---|---|---|
| 435,635 | 9/1890 | Schott | 273/145 C |
| 1,381,164 | 6/1921 | Bradbury | 273/145 C |
| 1,459,196 | 6/1923 | Cossitt et al. | 273/145 A |
| 2,296,001 | 9/1942 | Slattery | 273/145 C |
| 2,985,453 | 5/1961 | Matisz | 273/145 C |
| 3,508,755 | 4/1970 | Johnson | 273/145 C |
| 3,820,792 | 6/1974 | Woodall, Jr. | 273/145 C |

FOREIGN PATENT DOCUMENTS

| | | | |
|---|---|---|---|
| 634076 | 8/1936 | Fed. Rep. of Germany | 273/145 C |
| 2331800 | 1/1975 | Fed. Rep. of Germany | 273/145 C |
| 883705 | 3/1943 | France | 273/145 C |
| 1084650 | 7/1954 | France | 273/145 R |
| 285630 | 1/1953 | Switzerland | 273/145 C |
| 1267316 | 3/1972 | United Kingdom | 273/145 CA |

*Primary Examiner*—Richard C. Pinkham
*Assistant Examiner*—Arnold W. Kramer
*Attorney, Agent, or Firm*—Mills & Coats

[57] ABSTRACT

The present invention relates to a dice shaker assembly and more particularly to a die channel therefor wherein the particular die channel includes a channel enclosure and a die contained therein. The die channel is designed with voids such that the die will not lodge between the wall structure of the channel enclosure as it moves from a shaking and tumbling end to a receiving end where the die is closely surrounded by the side wall structure of the channel enclosure and rests within a receiving end of the channel.

8 Claims, 3 Drawing Figures

DIE CHANNEL DESIGN WITH ANTI-DIE LODGING PROVISION

The present invention relates to amusement devices and to games of chance, and more particularly to a dice shaker assembly and die channels therefor that are provided with means to prevent a die from lodging as it moves between the extreme ends of the die channel.

BACKGROUND OF THE INVENTION

In U.S. Pat. No. 3,820,792, I disclosed a dice shaker assembly that could be used in a variety of dice games, and which was particularly designed to be used in games such as "Liars Poker." Basically the dice shaker assembly included a plurality of die channels disposed in side-by-side relationship, with each die channel comprised of a wall structure that defined an enclosure having a generally varying rectangular cross sectional area from end to end. One end of the die channels included a cross sectional area of a substantial size relative to a selected die to be used therein in order that the die could shake and tumble within this end of the die channel. About the other end of the die channel, there was formed a die receiving end for receiving the die in a rest position, and the cross sectional area about this end was just slightly greater than the die and of a corresponding shape in order that when the die was disposed in this end the die would snugly fit within the side wall structure of the die channel in order that only one value of a plurality of values on the die face would register with a viewing opening formed about the lower front side of the die channel. Between the die receiving end and the other end, which may be referred to as a die shaking and tumbling end, the wall structure of the die channel tapered inwardly and consequently the cross sectional area of the die channel became smaller. This presented a problem in that as the respective dice would move from the shaking and tumbling end to the die receiving end it was not uncommon for a die to become lodged between opposed sides of a die channel. More particularly, the problem essentially involves two critical areas, one where the cross sectional area of the die channel is such that the distance between opposed sides is equal to the diagonal distance across opposed corners of a face of the die (referred to as a short diagonal distance), and the location where the distance between opposed sides of the die channel is equal to the distance between opposed corners through the die (referred to as a long diagonal distance). In utilizing the die shaker assembly shown in U.S. Pat. No. 3,820,792, it was not uncommon during a roll of the dice for certain dice to lodge between the wall structure of a respective die channel prior to the die reaching the normal rest position within the die receiving end of the respective channels. This, of course, interrupts the play of any game since a lodged die must be freed.

SUMMARY OF INVENTION

The present invention relates to a dice shaker assembly and particularly to a design for an individual die channel that prevents a die from lodging as it falls from the shaking and tumbling area about one end of the die channel towards the die receiving end. To prohibit lodging of an individual die within the channel, the side wall structure thereof is provided with void means about two critical vertically spaced locations within each die channel. Because of the basic design of the die channel, the two critical areas where lodging occurs is where the cross sectional area of the die channel is such that the distance between opposed sides is approximately $X\sqrt{2}$ and $X\sqrt{3}$. This is because that if the die is to lodge, it will lodge between a short diagonal, this being the distance between opposed corners of any side, or across a long diagonal, that being the distance between opposed corners through the body of the die.

To prevent the respective dice from lodging due to the short and long diagonals, the present invention provides a die channel with a generally rectangular cross sectional area where the side walls diverge outwardly from the lower die receiving area towards an upper die shaking and tumbling area, and wherein at the two critical locations where the distance between opposed sides of the wall structure is equal to $X\sqrt{3}$ or $X\sqrt{2}$, there is provided an open space just above and below each critical area about at least two adjacent sides of the die channel wall structure. Consequently, in these critical areas, it is impossible for the die to lodge.

It is, therefore, an object of the present invention to provide a die channel design of the type where one end of the die channel is only slightly greater in cross sectional area than the cross sectional area of the enclosed die itself and is adapted to snugly receive the die in a rest position, and to provide the die channel with an open tumbling and shaking area of a cross sectional area substantially greater than the cross sectional area of the die, and to provide means within each die channel to prohibit the die from lodging between opposed sides of the wall structure as the die falls from said shaking and tumbling area to said die receiving area.

Another object of the present invention is to provide a die channel of the character having a shaking and tumbling end from which the side wall structure thereof tapers inwardly to form a die receiving end that is only slightly greater in cross sectional area than a selected die contained therein, and wherein between the die shaking and tumbling end and the die receiving end there is provided openings within the side wall structure of the die channel at strategically critical locations to prevent the die from lodging between opposed sides of the die channel.

A further object of the present invention is to provide a die channel assembly including a die shaking enclosure that is generally rectangular in cross sectional, includes four sides, two ends, an enclosed six sided die, and wherein the cross sectional area varies from a die receiving end where the cross sectional area is just greater than the cross sectional area of said die to a shaking and tumbling end where the cross sectional area is relatively large so as to allow the die to shake and tumble therein, and wherein between said ends at least at two critical vertically spaced locations where the distance between respective sides of the die shaking enclosure is equal to the long and short diagonals of the die, there is provided selected openings within the sides of the die shaking enclosure in order to prevent the die from lodging as it falls from said shaking and tumbling area to said die receiving area.

Other objects and advantages of the present invention will become apparent from a study of the following description and the accompanying drawings which are merely illustrative of the present invention.

BRIEF DESCRIPTION OF PREFERRED EMBODIMENT

Figure 1:
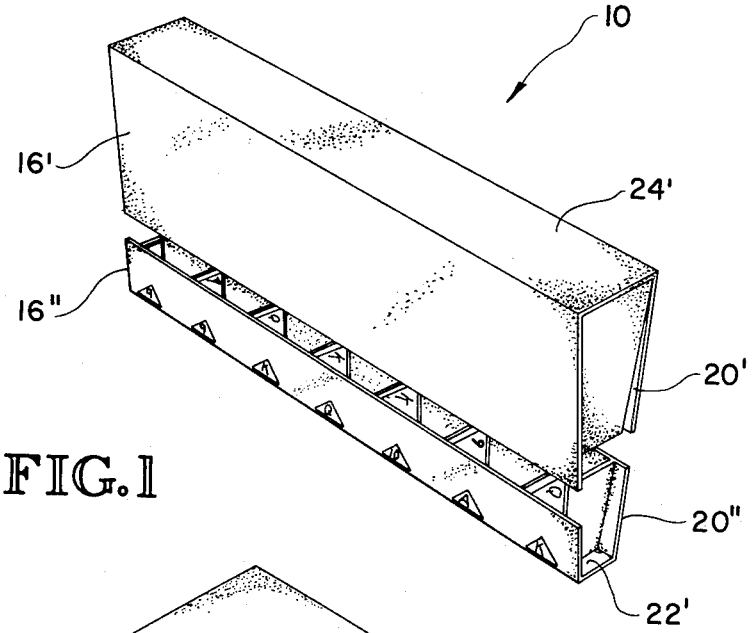
FIG. 1 is a perspective view of a dice shaker assembly including a plurality of die channels constructed in accordance with the present invention and disposed in side-by-side relationship.

With further reference to the drawings, a dice shaker assembly is shown in FIG. 1 and indicated generally by the numeral 10. Dice shaker assembly 10 includes a plurality of die channels, each indicated generally by the numeral 12, disposed in side-by-side relationship to form a multi-channel dice shaker assembly. For purposes of a background understanding and appreciation of the basic function and utility of a dice shaker, one is referred to my U.S. Pat. No. 3,820,792, the disclosure of which is expressly incorporated herein by reference.

Figure 2:
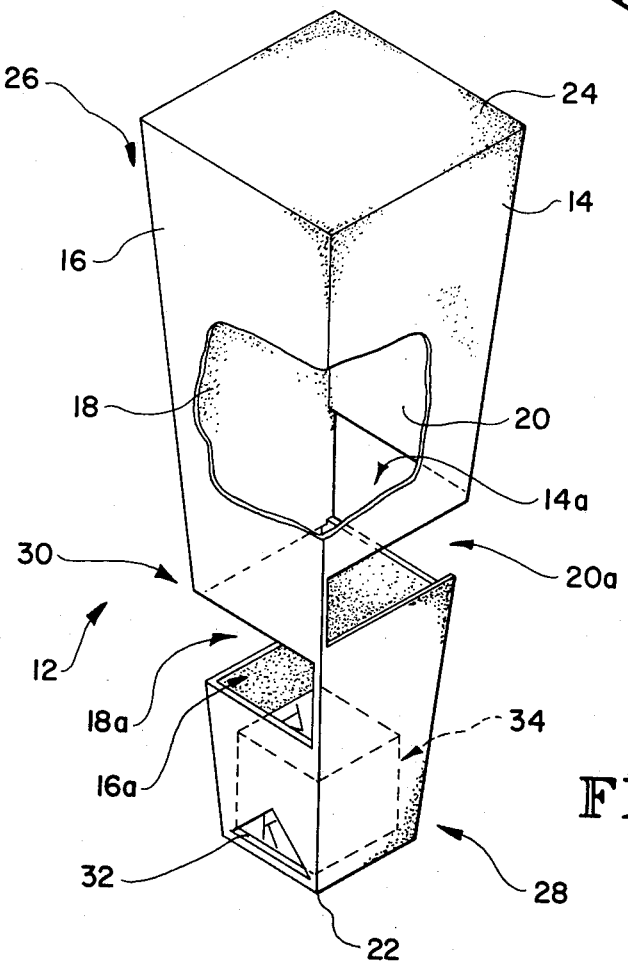
FIG. 2 is a perspective view of the die channel of the present invention with portions of the wall structure being broken away to better illustrate the structure thereof.

Referring to the structure of a respective die channel 12, one is referred to FIG. 2 where the die channel is shown and from a review of the drawing, it is seen that the same includes four sides 14, 16, 18 and 20, and two ends 22 and 24. Together the sides and ends just referred to comprise an enclosure that includes an open area therein for receiving a die, such as a die 34 shown in FIGS. 2 and 3. In the design of the die channel 12 shown in FIG. 2 the same includes a generally rectangular cross sectional area from the lower end thereof to the upper end. In accordance with this particular shape, the die channel 12 can be said to include an upper shaking and tumbling end portion 26, a lower die receiving end portion 28, and an intermediate die aligning portion 30 which is that portion of the die channel 12 that lies generally between the extreme end portions 26 and 28. More particularly, the particular die channel 12 of the present invention is designed such that the upper shaking and tumbling end 26 includes a cross sectional area substantially greater than the cross sectional area of the die 34 contained therein, in order that the die can be agitated about the shaking and tumbling end 26 to achieve a random value once the die falls to its rest position. The die receiving end portion 28, on the other hand, is of a cross sectional area just slightly greater than the cross sectional area of the die 34 such that when the die is disposed in a rest portion, as indicated in FIGS. 1 and 2, the die will be disposed about the die receiving end portion 28 and will be supported about the lower end 22 of the die channel. The cross sectional area about the die receiving end 28 is such that the die snugly fits within the boundaries of the sides 14, 16, 18 and 20 such that only one of the sets of indicia disposed adjacent the lower front side 16 can be seen through an opening 32 formed about the lower front portion of side 16.

Figure 3:
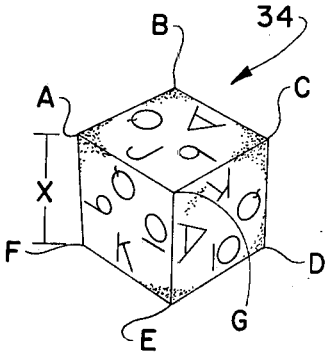
FIG. 3 is a perspective view of a die of the type adapted to be contained within each respective die channel.

Therefore, it is appreciated that from the shaking end 26 to the die receiving end 28 the cross sectional area of the die channel 12 becomes progressively smaller. Because of this, and because the die 34 may be oriented in many different positions as it falls from the shaking end 26 to the die receiving end 28, it is not uncommon in such a die channel design for the die 34 to lodge between opposed sides of the die channel. In particular, it is appreciated that as one approaches the lower extremity of the die channel 12 or the portion referred to as a die receiving end portion 28, that the distance between opposed sides of the die channel is less than the distance between certain opposed corners of the die, as shown in FIG. 3. In this regard, there are two critical situations in which the die 34 can lodge between opposed sides of the die channel 12.

With reference to FIG. 3, it is seen that certain corners of the die 34 is referred to by A, B, C, D, E, F and G. There are essentially two situations where the die 34 can lodge within the die channel 12 as the die falls from the shaking and tumbling end, through the aligning portion 30 towards the die receiving end portion 28. The first situation is the situation referred to as the lodging across a short diagonal of the die's face. A short diagonal is that distance between opposed corners of the die face. And these short diagonals (for the three faces shown) would be referred to as the distance between AC, BG, AE, FG, GD, and CE. The other situation is referred to as a long diagonal situation and that is where the die could lodge between opposed sides across the long diagonal thereof. With reference to FIG. 3, a distance referred to as a long diagonal distance (for the three faces shown) is the straight line distance between AD, BE, and CF.

It is appreciated that if the length of the sides of the die 34 are all equal and referred to as being a length X, then the short diagonal distance would be $X\sqrt{2}$ while the long diagonal distance wouuld be $X\sqrt{3}$. Therefore, to prohibit the lodging of the die across short and long diagonals, the present invention provides a design where at these two critical areas where the cross sectional area of the die channel 12 is such that the distance between opposed sides is equal to $X\sqrt{2}$ and $X\sqrt{3}$, there is void means within the side wall structure of the die channel to prohibit the same from lodging.

In sides 16 and 18, there is provided voids or cutouts **16*a* and 18*a* that are generally centered such that the distance between the vertical mid-point of each void or cutout to the opposite side is generally equal to $X\sqrt{2}$. Therefore, it is appreciated that the die 34 cannot lodge across a short diagonal within the die channel 12 where the distance between opposite sides is generally equal to $X\sqrt{2}$. To take care of situations where the short diagonal of the die 34 could lodge at an angle, that is where the short diagonal would not be horizontally aligned, the voids or cutouts 16*a* and 18*a* extend above and below the critical line distance where the distance between opposed sides is equal to the $X\sqrt{2}$. The height of the voids or cutouts 16*a* and 18*a* can vary, but preferably would be less than the length X of the respective sides of the die 34**.

To accommodate the other critical situation, sides 14 and 20 include voids or cutouts **14*a* and 20*a*. Cutouts 14*a* and 20*a* are particularly provided such that the horizontal center line is disposed at a level where the distance between opposed sides is generally equal to $X\sqrt{3}$. It is appreciated that this is the critical cross sectional area location where the die 34 could lodge between opposed sides of the die channel across any one of the long diagonals referred to above. Because again it is possible for the die 34 to lodge across a long diagonal that is not horizontally leveled with respect to the die channel 12, the voids or cutouts 14*a* and 20*a* are such that they extend open above and below the horizontal center line thereof. Again, the height of the voids or cutouts 14*a* and 20*a*** may vary, but it is desirable that the height of such be less than the length of a side X.

Therefore, in operation, to establish a new roll or new value, the die channel or die shaker assembly 10 is turned such that the die 34 falls from the die receiving end 28 to the shaking and tumbling end 26. Once the die is in this portion of the die channel, the same can be shaken such that the die is rolled, tumbled and generally agitated within the upper shaking and tumbling end portion 26 of the die channel. Then the die channel is oriented such that the die receiving end 28 assumes a lower position, such that the die 34 will move under the influence of gravity towards the die receiving end 28. Because of the voids 16*a*, 18*a*, 14*a*, and 20*a*, the die 34 will not lodge between opposed sides of the die channel structure across either a short diagonal or a long diagonal of the die. It should be pointed out that the die may hang or catch about these voided areas. It is important to realize the distinction between lodging on one hand and hanging or catching on the other hand. When the die 34 hangs or catches about the voided areas, which practically is rare, it can be induced to fall on down into the die receiving end by simply jiggling or gently shaking the die channel 12 without disrupting the other dice in the shaker 10. If the die were lodged, a simple jiggle or slight movement of the die channel would not be sufficient to free the die from its lodged position.

With reference to FIG. 1, the die shaker assembly 10 shown therein comprises a series of die channels that conform in principle to the die channel construction shown in FIG. 2 and described hereinabove. Die shaker assembly 10 for purposes of a more practical construction may include a continuous top end 24' and a continuous lower end 22'. The front of the die shaker assembly 10 includes an upper front side 16' and a lower front side 16''. The space between sides 16' and 16'' forms the void that corresponds to void 16*a* shown in FIG. 2. Likewise, about the back side of the die shaker assembly 10, there is provided an upper side 20' and a lower side 20'' with the space therebetween conforming to the space 20*a* in FIG. 2. To form the respective die channels within the die shaker assembly 10, the other sides for each die channel are secured between the front and back continuous sides 16', 16'', 20' and 20''. Again these two sides for each die channel would include corresponding openings such that at least two sides of each die channel would include voids or cutouts at the two critical areas within the die channel, the critical areas being where the distance between opposed sides is generally equal to $X\sqrt{2}$, and $X\sqrt{3}$.

From the foregoing specification, it is appreciated that the die channel 12 of the present invention is a substantial improvement over such die channels in the prior art in that the common problem of die lodging is obviated by the provision of the voids or cutouts 16*a*, 18*a*, 14*a*, and 20*a* in the strategic cross sectional locations of the die channel.

The terms "upper," "lower," "forward," "rearward," etc., have been used herein merely for the convenience of the foregoing specification and in the appended claims to describe the die channel design with anti-die lodging provision and its parts as oriented in the drawings. It is to be understood, however, that these terms are in no way limiting to the invention since the die channel design with anti-die lodging provision may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced herein.

What is claimed is:

1. A die and die channel designed for allowing the die in the form of a cube to move back and forth between respective ends thereof without lodging, the die channel comprising a side wall structure with two end portions that define an interior space therein where the die can move back and forth between ends thereof; said die channel about one end portion including a die shaking and tumbling area and wherein the cross sectional area thereof is substantially greater than the cross sectional area of said die; formed about the other end portion is a die receiving area that includes a cross sectional area just slightly greater in cross sectional area than the die and of a corresponding shape in order that the selected die when disposed in the receiving area snugly fits within the adjacent side wall structure of the die channel with said die channel converging from said shaking and tumbling area to said receiving area; intermediately between said die receiving area and said die shaking and tumbling area there is formed void means provided partially about sides of said side wall structure so as to prevent lodging of a die prior to reaching said receiving area, said void means providing an open area at certain locations within the die channel that enables the die to pass therethrough without lodging on the short or long diagonal of the die irrespective of the orientation of the die with respect to the side wall structure of the die channel.

2. The invention of claim 1 wherein the die channel includes four sides that diverge outwardly as they extend from the die receiving area towards said shaking area; and wherein said die includes sides that each have a selected length X; and wherein said void means includes open space areas formed about a substantial portion of the side wall structure of said die channel generally at locations where the distance between respective opposed sides is generally $X\sqrt{2}$ and $X\sqrt{3}$ to prevent lodging of the die on the respective short or long diagonal.

3. The invention of claim 2 wherein said void means in the form of said open space areas is provided about at least two adjacent sides at each location where said void means is provided.

4. A die and die channel for receiving the die with the die having a plurality of faces each having a length X and which channel is adapted to allow the die to tumble and move from end to end without lodging, said die channel comprising: a generally elongated enclosure having a side wall structure and two ends which define a die channel having a die receiving end portion, a shaking and tumbling end portion, and an intermediate aligning portion through which said die moves in falling from said shaking and tumbling end portion to said die receiving end portion; said side wall structure including at least four sides that diverge outwardly from said die receiving end portion toward said shaking and tumbling end portion and with respective sides projecting generally in a straight plane over a substantial length of said die channel; and anti-lodging void means formed in the side wall structure of the die channel to prevent said die from lodging at two critically vertically spaced areas within the die channel where the distance between respective opposed sides is generally $X\sqrt{2}$ and $X\sqrt{3}$, said anti-lodging void means including openings strategically formed in at least two adjacent sides at two vertically spaced locations within the die channel where the distance between opposing sides is generally $X\sqrt{2}$ and $X\sqrt{3}$ which is the respective short and long diagonal of the die.

5. The invention of claim 4 wherein said die channel is of a generally rectangular cross sectional shape and wherein said die receiving end portion includes a die resting end that is rectangular in cross sectional area and is slightly greater in cross sectional area than said die in order that the die may snugly rest within said die resting end of said die channel.

6. The invention of claim 5 wherein said openings formed in adjacent sides of said die channel at said two critical areas extend above and below the line location where the critical distance is $X\sqrt{2}$ and $X\sqrt{3}$ between respective opposed sides, so as to form openings with an open area and wherein the height of each open area of said openings is less than X.

7. The claimed invention of claim 6 wherein a plurality of said die channels are disposed in side-by-side relationship to form a dice shaker assembly, and wherein each die channel includes a viewing opening formed within the lower front of each die channel with the area of said viewing opening being substantially less than the area of a respective face of an individual die contained within a respective die channel.

8. The invention of claim 7 wherein the die of each die channel is of the conventional six sided cubical type, and wherein each side of the die includes a plurality of separate and distinct indicia inscribed thereon with the indicia on each side being arranged such that only one particular indicia registers with said viewing opening when the die is disposed in the receiving end of the die channel.

* * * * *